US012022950B2

(12) United States Patent
Donati

(10) Patent No.: US 12,022,950 B2
(45) Date of Patent: Jul. 2, 2024

(54) OSCILLATION MECHANISM FOR A CHAIR OR ARMCHAIR

(71) Applicant: Donati S.p.A., Rodengo Saiano (IT)

(72) Inventor: Armando Donati, Rodengo Saiano (IT)

(73) Assignee: Donati S.P.A., Rodengo Saiano (IT)

( * ) Notice: Subject to any disclaimer, the term of this patent is extended or adjusted under 35 U.S.C. 154(b) by 144 days.

(21) Appl. No.: 17/797,783

(22) PCT Filed: Dec. 23, 2020

(86) PCT No.: PCT/IB2020/062387

§ 371 (c)(1),
(2) Date: Aug. 5, 2022

(87) PCT Pub. No.: WO2021/156672

PCT Pub. Date: Aug. 12, 2021

(65) Prior Publication Data

US 2023/0068287 A1 Mar. 2, 2023

(30) Foreign Application Priority Data

Feb. 6, 2020 (IT) ..... 102020000002332

(51) Int. Cl.
*A47C 1/032* (2006.01)
*A47C 1/033* (2006.01)

(52) U.S. Cl.
CPC ..... *A47C 1/03266* (2013.01); *A47C 1/03255* (2013.01); *A47C 1/03277* (2013.01)

(58) Field of Classification Search
CPC ..... A47C 1/03255; A47C 1/03266; A47C 1/03277; A47C 7/029; A47C 7/282
See application file for complete search history.

(56) References Cited

U.S. PATENT DOCUMENTS 3,740,792 A * 6/1973 Werner ..... A47C 3/026 297/303.1 X
4,889,385 A * 12/1989 Chadwick ..... A47C 7/441 297/285
5,114,210 A * 5/1992 Naess ..... A47C 3/026 297/285
6,276,755 B1 * 8/2001 Su ..... A47C 1/03272 297/301.6 X (Continued)

FOREIGN PATENT DOCUMENTS

EP 2046165 A1 4/2009
EP 3409144 A1 12/2018

(Continued)

OTHER PUBLICATIONS

International Search Report and Written Opinion for International Patent Application No. PCT/IB2020/062387, mailed Feb. 11, 2021, 11 pages.

*Primary Examiner* — Rodney B White
(74) *Attorney, Agent, or Firm* — Armstrong Teasdale LLP

(57) ABSTRACT

An oscillation mechanism for a seat or a backrest of a chair or of an armchair is provided. The oscillation mechanism has a seat coupling, a backrest coupling, and a functional body made in a single piece of plastic material and consisting of a flexible unit portion, the functional body being elastically deformable by bending for the oscillation of the seat and of the backrest.

10 Claims, 6 Drawing Sheets

(56) References Cited

U.S. PATENT DOCUMENTS

| | | | | |
|---|---|---|---|---|
| 6,447,063 | B1 * | 9/2002 | Beggs | A47C 1/03272 297/300.5 |
| 6,729,688 | B2 * | 5/2004 | Erne | A47C 1/03277 297/320 |
| 6,959,965 | B2 * | 11/2005 | Diffrient | A47C 1/023 297/316 |
| 7,806,478 | B1 * | 10/2010 | Cvek | A47C 1/03266 297/300.1 |
| 8,029,060 | B2 * | 10/2011 | Parker | A47C 7/004 297/300.1 |
| 8,087,727 | B2 * | 1/2012 | Parker | A47C 7/445 297/316 |
| 9,033,421 | B2 * | 5/2015 | Wilkinson | A47C 7/004 297/452.64 |
| 9,560,917 | B2 * | 2/2017 | Roslund, Jr. | A47C 7/441 |
| 9,883,746 | B2 * | 2/2018 | Piretti | A47C 1/03294 |
| 10,016,061 | B2 * | 7/2018 | Brueske | A47C 7/462 |
| 10,206,513 | B2 * | 2/2019 | Brueske | A47C 7/006 |
| 10,383,448 | B1 * | 8/2019 | VerBeek | A47C 1/022 |
| 10,595,636 | B2 * | 3/2020 | Jin | A47C 1/03255 |
| 10,624,457 | B2 * | 4/2020 | Schmitz | A47C 7/445 |
| 11,109,683 | B2 * | 9/2021 | Deevers | A47C 7/282 |
| 11,197,548 | B2 * | 12/2021 | Theesfeld | A47C 1/03255 |
| 11,324,325 | B2 * | 5/2022 | Ludwig | A47C 3/12 |
| 11,357,329 | B2 * | 6/2022 | Deevers | A47C 1/03261 |
| 11,375,820 | B2 * | 7/2022 | Deevers | A47C 1/03277 |
| 11,602,223 | B2 * | 3/2023 | Deevers | A47C 31/023 |
| 11,779,121 | B2 * | 10/2023 | Gilchrist | A47C 7/445 297/301.1 |
| 2002/0109384 | A1 | 8/2002 | Hansen | |
| 2008/0290712 | A1 * | 11/2008 | Parker | A47C 7/14 297/354.11 |
| 2013/0200674 | A1 * | 8/2013 | Jones | A47C 1/03294 297/319 |
| 2016/0220025 | A1 | 8/2016 | Piretti | |
| 2017/0231394 | A1 | 8/2017 | Brueske | |

FOREIGN PATENT DOCUMENTS

| | | | |
|---|---|---|---|
| EP | 3620082 | A1 | 3/2020 |
| IT | 201800003431 | A1 | 9/2019 |
| WO | 2010097818 | A1 | 9/2010 |
| WO | 2011104735 | A1 | 9/2011 |
| WO | 2015145216 | A1 | 10/2015 |

* cited by examiner

OSCILLATION MECHANISM FOR A CHAIR OR ARMCHAIR

CROSS-REFERENCE TO RELATED APPLICATIONS

This application is a National Stage Application of International Patent Application No. PCT/IB2020/062387, having an International Filing Date of Dec. 23, 2020, which claims priority to Italian Application No. 102020000002332, filed Feb. 6, 2020, the entire contents of each of which are incorporated by reference herein.

FIELD OF THE INVENTION

The present invention belongs to the field of the oscillation mechanisms for seats of chairs or armchairs, for example, office chairs or armchairs.

BACKGROUND OF THE INVENTION

The field of chairs and armchairs, especially office chairs or armchairs, is highly demanding as regards comfort of use, so that modern solutions provide for multiple adjustments (for example, the height of the seat, the inclination of the backrest and seat, etc.), in order that the user may better adjust his/her position.

Some solutions further include an oscillating backrest, so that it moves backwards when the user leans the back thereon, or an oscillating seat, so that it adapts to the position of the user, for example, sitting very forward or very backward.

The backrest and the seat oscillation possibilities are conferred by an oscillation mechanism supported at a predefined height by a stem and, in turn, carrying the seat and the backrest of the chair.

Some solutions of oscillation mechanisms are described in documents WO-A1-2010/097818, WO-A1-2011/104735, WO-A1-2015/145216, IT201800003431, to the Applicant.

In such a field, competition is very strong and companies make considerable efforts to research and develop new solutions, both aimed at improving the comfort of the final product as well as at increasing the profitability of a product by lowering the production costs thereof.

In particular, given the structural and functional complexity of the oscillation mechanisms, considerable efforts are made to simplify such mechanisms.

It is the object of the present invention to provide an oscillation mechanism for a chair or armchair which meets the comfort requirements of the field and overcomes the drawbacks mentioned above regarding the structural complexity of the existing solutions.

SUMMARY OF THE INVENTION

Such object is achieved by an oscillation mechanism as described and claimed herein. Advantageous embodiments of the present invention are also described.

BRIEF DESCRIPTION OF THE FIGURES

The features and advantages of the oscillation mechanism according to the present invention will become apparent from the following description, given by way of non-limiting example, according to the accompanying drawings, in which.

DETAILED DESCRIPTION

Figure 1:
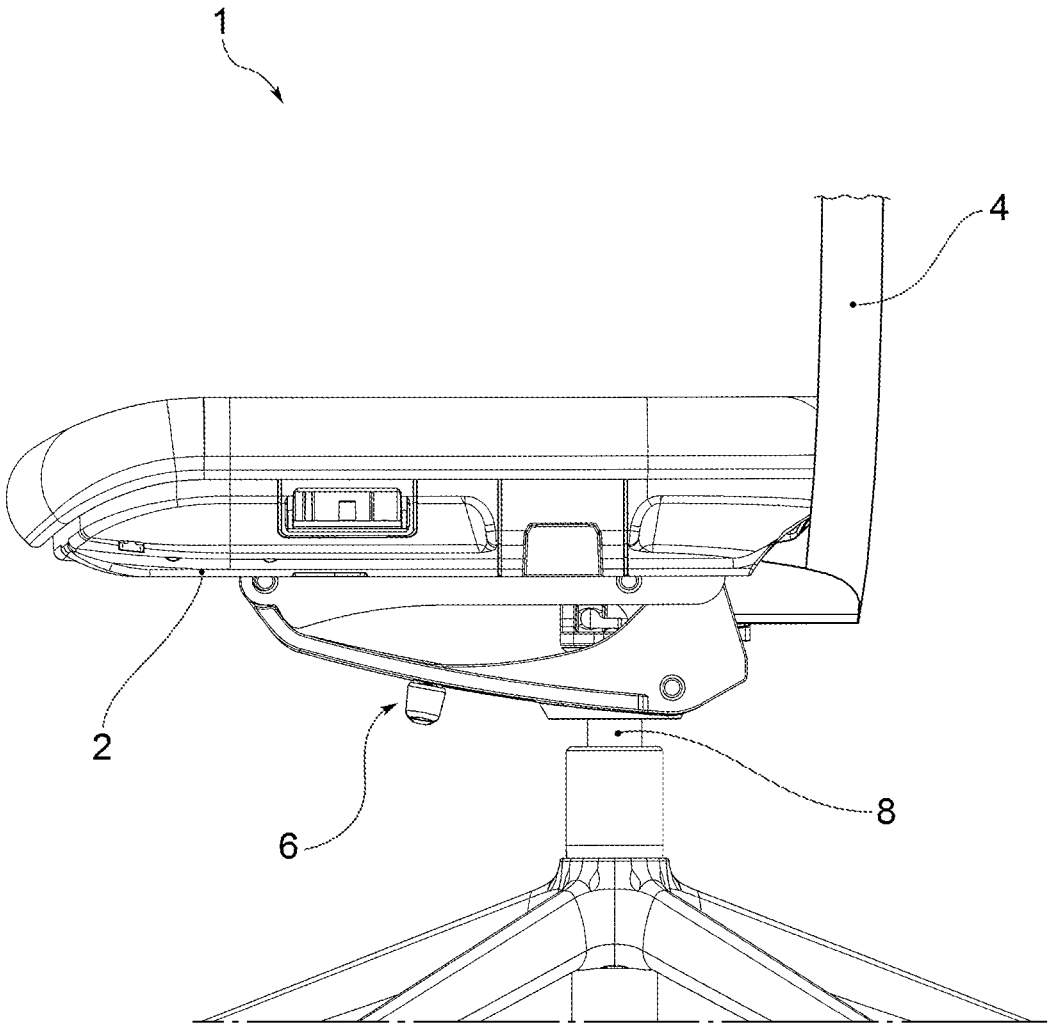
FIG. 1 shows a chair provided with an oscillation mechanism according to an embodiment of the present invention.
Figure 2:
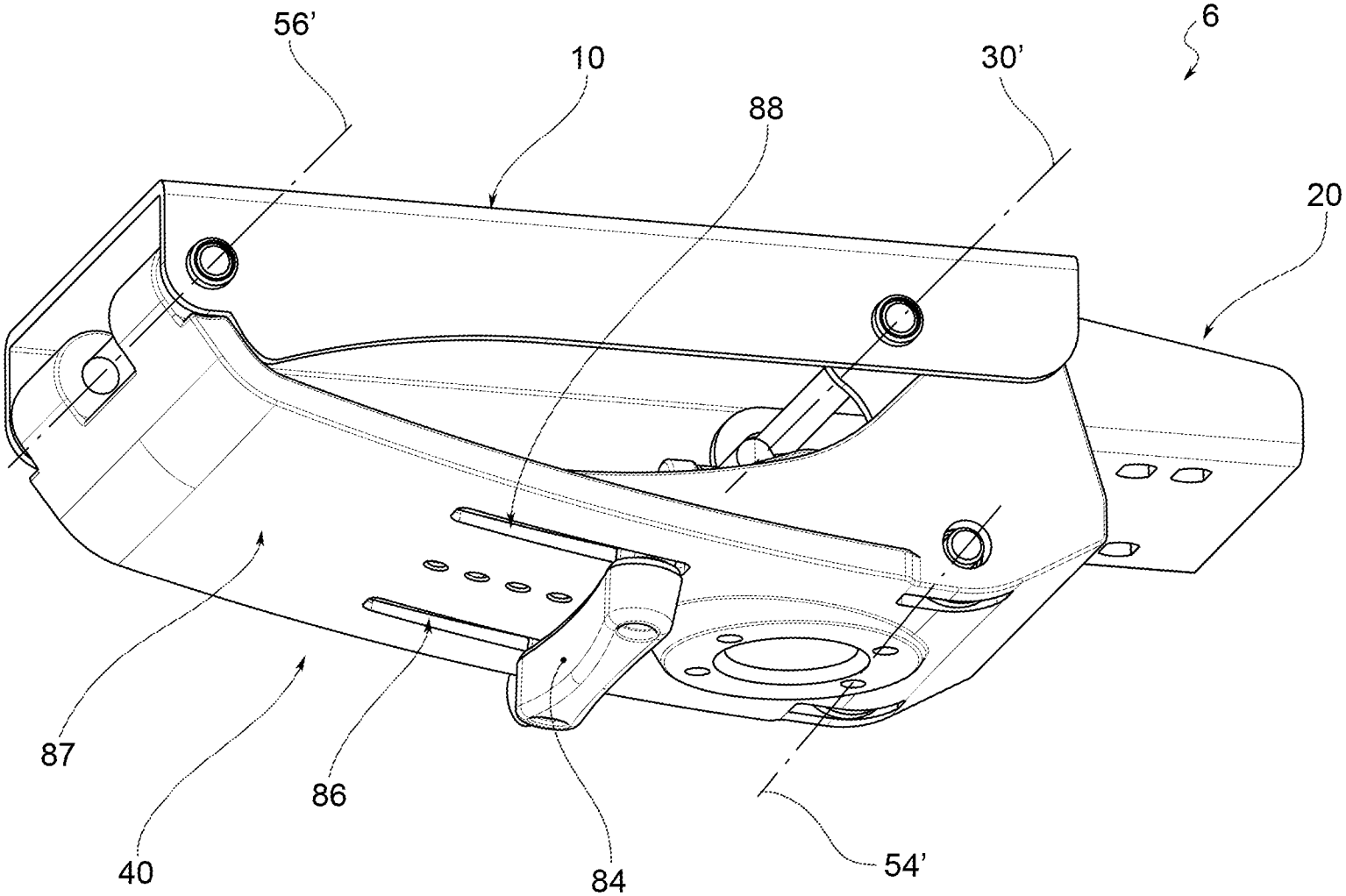
FIG. 2 illustrates the oscillation mechanism in FIG. 1.
Figure 3:
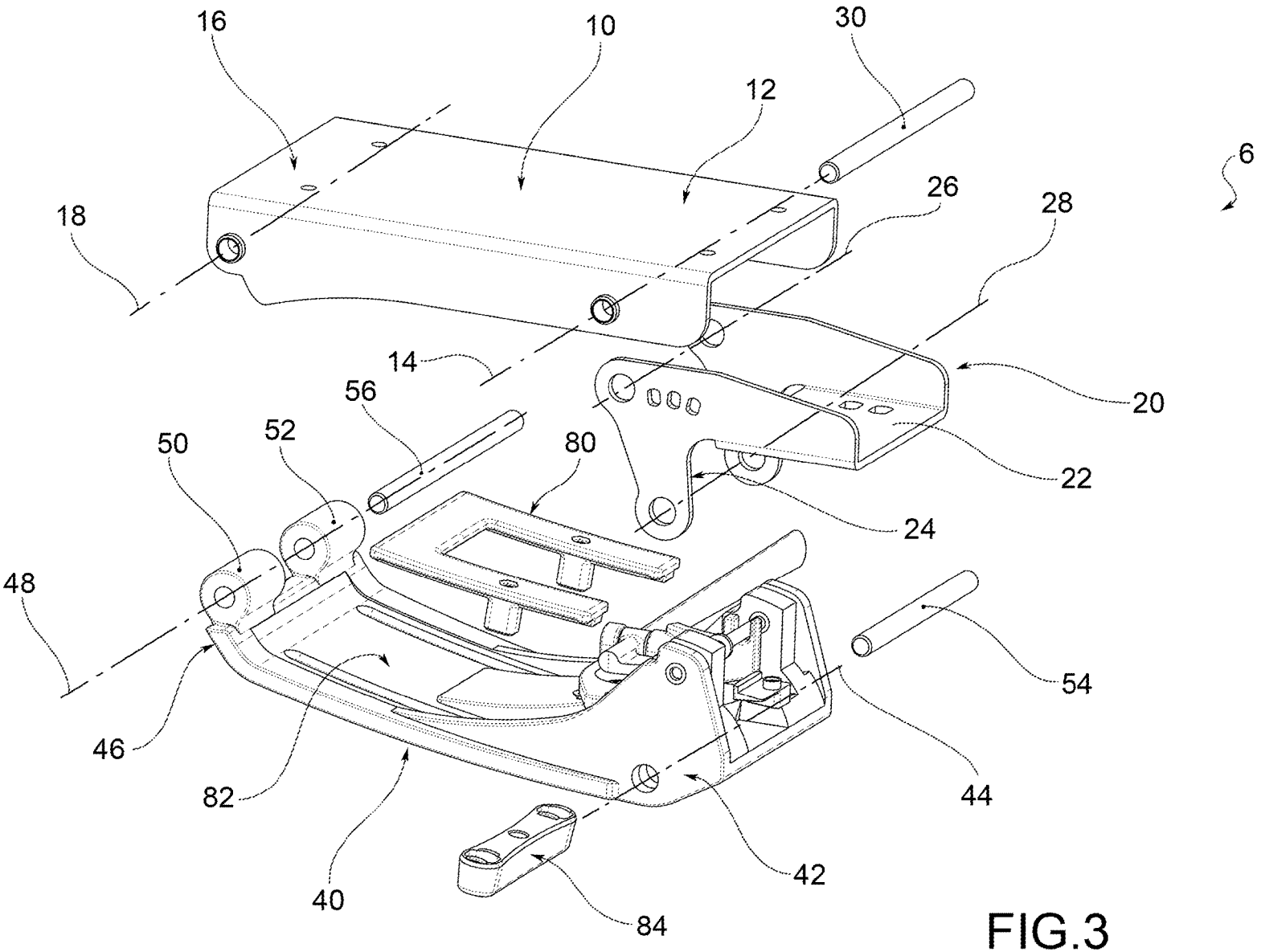
FIG. 3 depicts the oscillation mechanism in FIG. 2, with separate parts.

With reference to the figures of the accompanying drawings, 1 indicates a chair or armchair as a whole, comprising a seat 2, a backrest 4, an oscillation mechanism 6, and a stem 8.

The stem 8, consisting for example of a gas piston, supports the oscillation mechanism 6 at a predefined height with respect to a ground plane, and is adjustable according to the needs of the user.

The oscillation mechanism 6 comprises a seat coupling 10, which is mechanically connectable by means for example of screws, to the seat 2 of the chair.

Said seat coupling 10 extends between a rear portion 12, where it has a rear seat coupling axis 14, and a front portion 16, where it has a front seat coupling axis 18.

The oscillation mechanism 6 further comprises a backrest coupling 20, which is mechanically connectable by means for example of screws, to the backrest 4 of the chair.

For example, said backrest coupling 20, being for example L-shaped, comprises a rear coupling portion 22 for the connection to the backrest 4, and a front connection portion 24.

Said front connection portion has an upper backrest coupling axis 26 and a lower backrest coupling axis 28.

The seat coupling 10 is hinged to the backrest coupling 20 by engaging the rear seat coupling axis 14 with the upper backrest coupling axis 26, engaged by means of for example a first pin 30, which forms a rear hinge axis 30'.

The oscillation mechanism 6 further comprises a functional body 40 made in a single piece, for example by molding, of plastic material.

For example, said functional body 40 is made of polyamide.

The functional body 40 extends from a rear portion 42, where it has a rear body axis 44, to a front portion 46, where it has a front body axis 48, for example obtained by means of a plurality of hinge elements 50, 52, separated along said front body axis 48.

The functional body 40 is hinged to the backrest coupling 20 by engaging the lower coupling axis 28 with the rear body axis 44 by means for example of a second pin 54, which forms a lower hinge axis 54'.

The functional body 40 is hinged to the seat coupling 10 by engaging the front body axis 48 with the front seat coupling axis 18 by means for example of a third pin 56, which forms a front hinge axis 56'.

The functional body 40 is configured to be elastically deformable, by bending, between the rear body axis 44 and the front body axis 48, i.e., between the lower hinge axis 54' and the front hinge axis 56'.

According to a preferred embodiment, the functional body 40 has, between the rear body axis 44 and the front body axis 48, differentiated-flexibility zones, and in particular a low flexibility zone 60, which is proximal to the rear body axis 44, and a high flexibility zone 62, which is proximal to the front body axis 48.

For example, the functional body 40 comprises, within said low flexibility zone 60, a plurality of ribs 64, which structurally accentuate the bending rigidity of said low flexibility zone 60.

Figure 4:
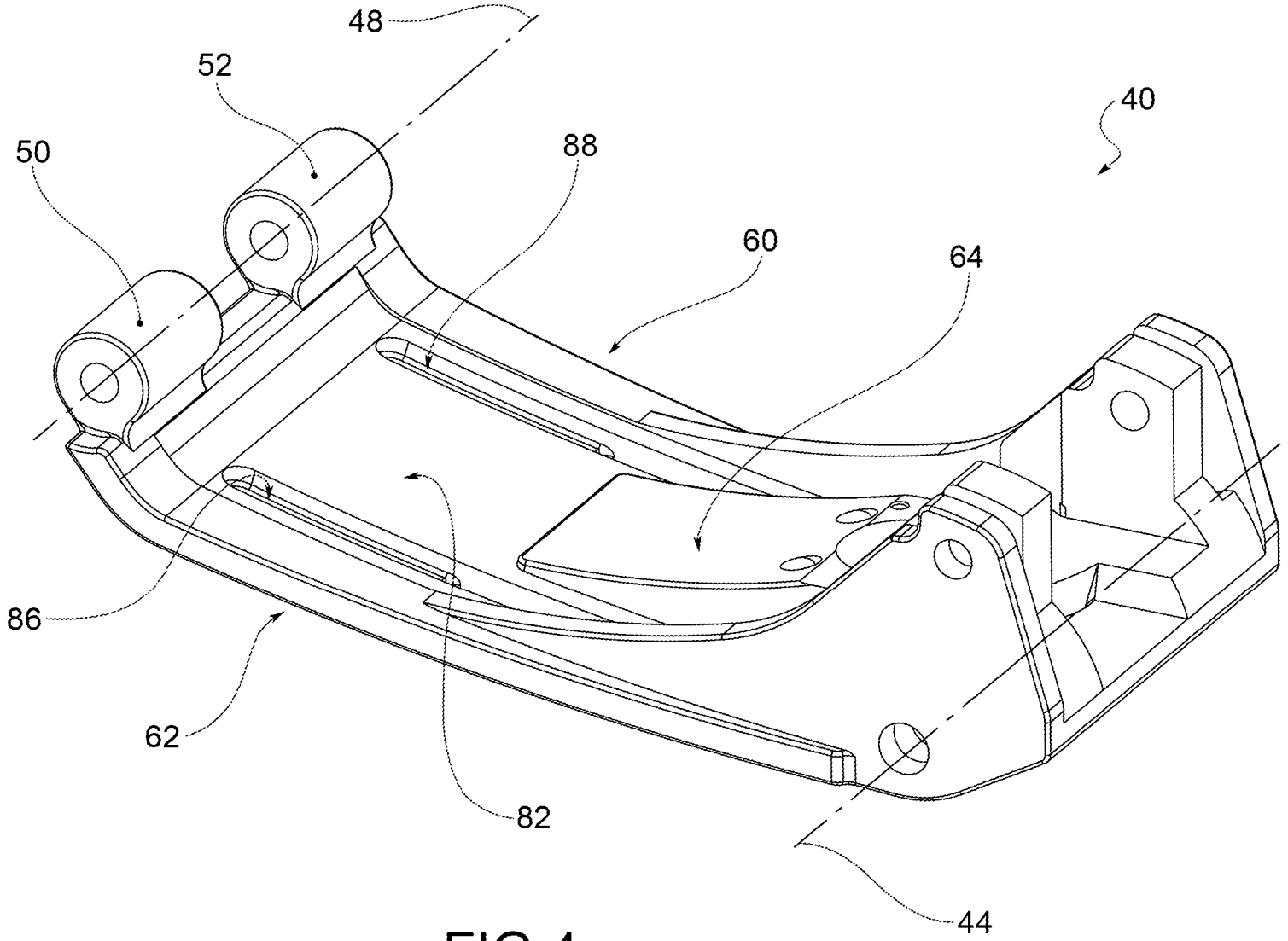
FIG. 4 depicts a functional body of the oscillation mechanism, according to an embodiment of the invention.
Figure 5:
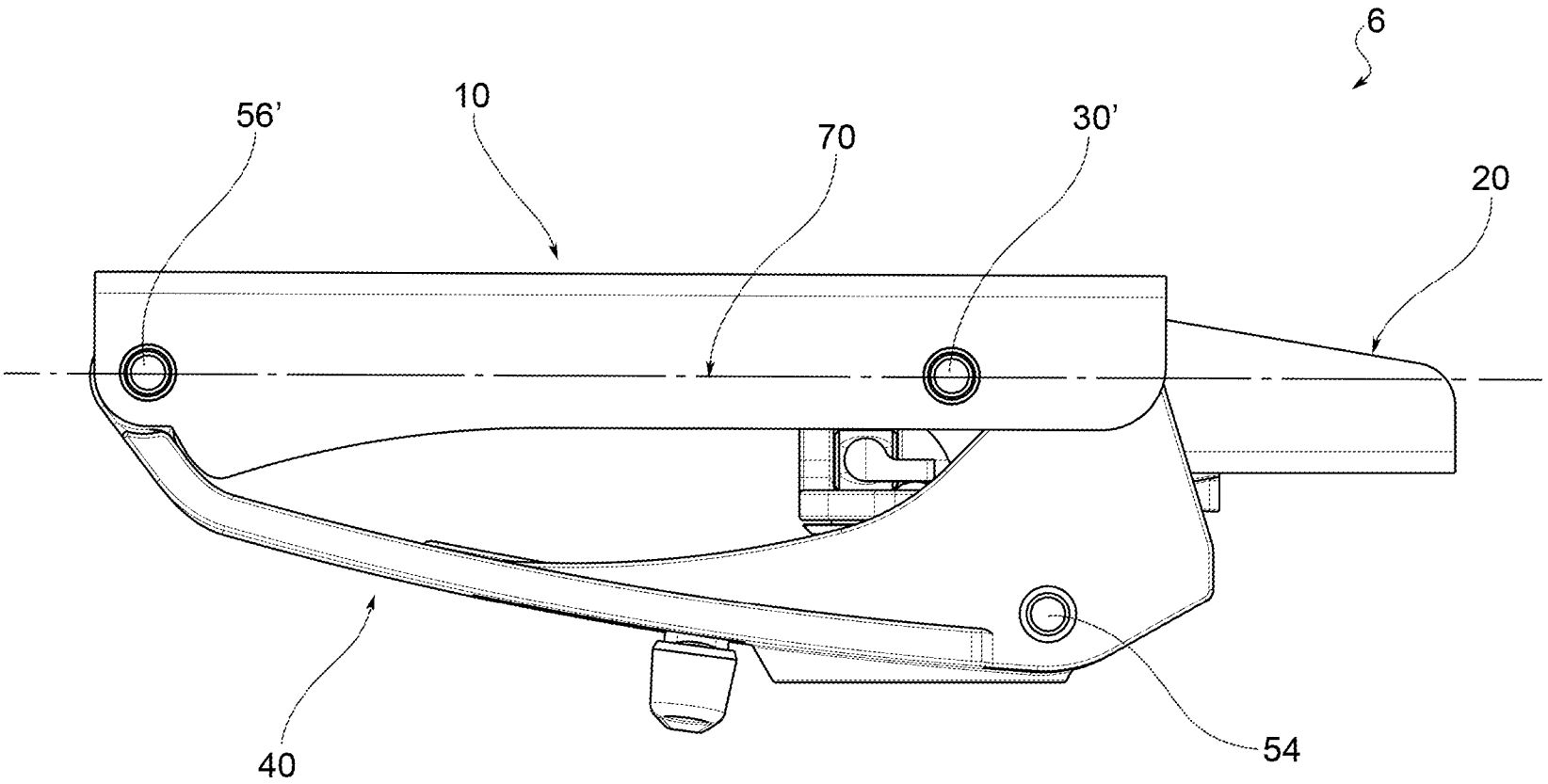
FIG. 5 shows the oscillation mechanism in an initial or resting configuration.
Figure 6:
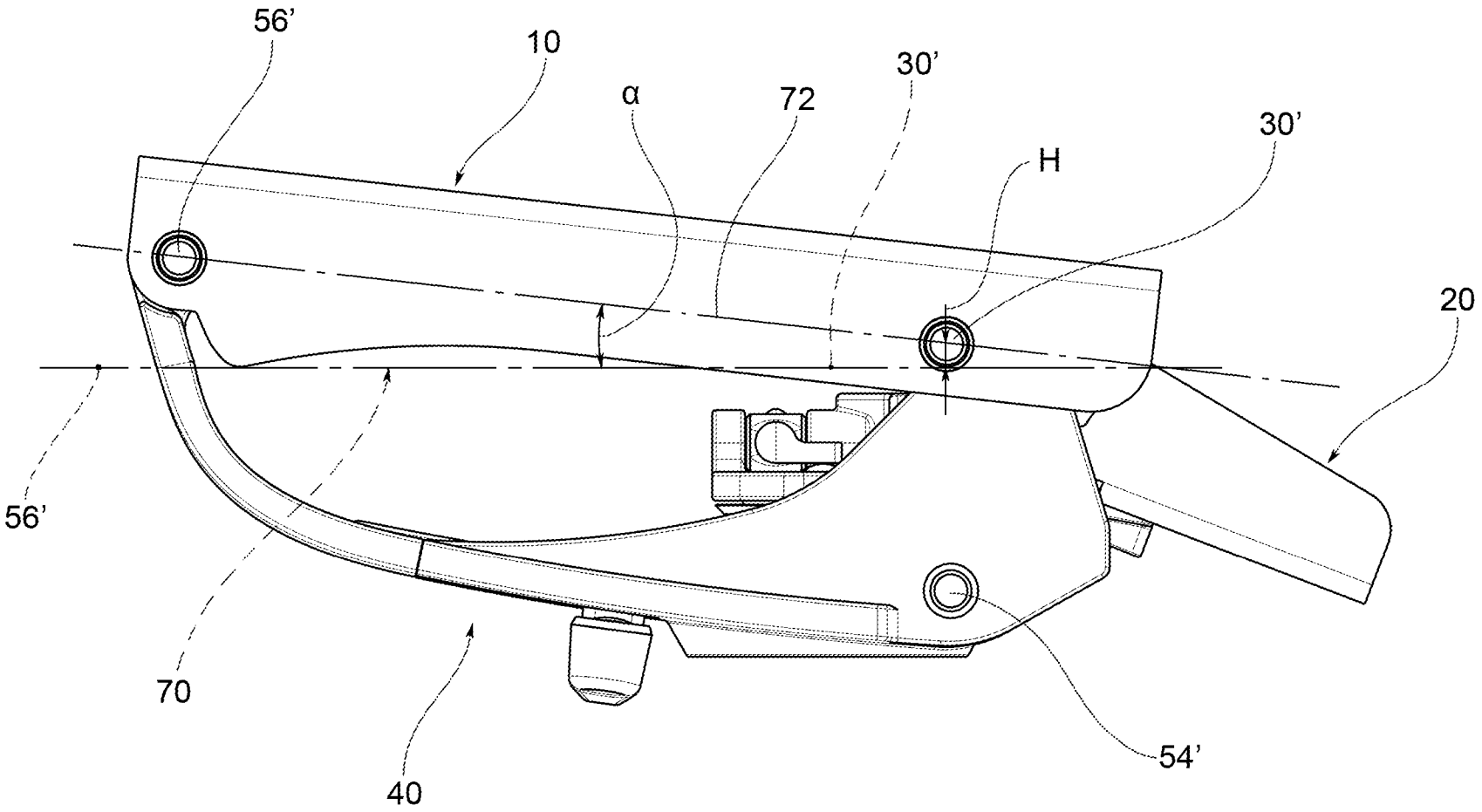
FIG. 6 depicts the oscillation mechanism in a final configuration.

By virtue of the deformability of the functional body 40, the oscillation mechanism 6 is suitable for switching from an initial or resting configuration (FIG. 4), in which the front hinge axis 56' and the rear hinge axis 30' lie on a first imaginary plane 70, to a final configuration (FIG. 6), in which the front hinge axis 56' and the rear hinge axis 30' lie on a second imaginary plane 72.

The second imaginary plane 72 is inclined with respect to the first imaginary plane 70 by an angle $\alpha$ corresponding to the maximum inclination of the seat.

According to an embodiment, the mutual distance between the front hinge axis 56', the rear hinge axis 30', and the lower hinge axis 54' is configured so that the position taken by the rear hinge axis 30' in the final configuration is placed at a predefined height H above the first imaginary plane 70.

In other words, such a feature ensures that the oscillation mechanism is of the "self-weighting" type.

According to an embodiment of the present invention, the oscillation mechanism 6 further comprises adjustment means adapted to adjust manually the flexibility of the functional body 40.

For example, said adjustment means comprise a bracket 80 which cooperates with the functional body 40, so as to structurally stiffen it, and is manually positionable between the rear portion 42 and the front portion 46. For example, the bracket 80 cooperates with the functional body 40 by sliding on an upper surface 82 of said functional body.

When the bracket 80 is proximal to the rear portion 42, the region of the functional body 40 which spans from the bracket 80 to the front body axis 48 is free from stiffenings and therefore has a high flexibility; as the bracket 80 is positioned closer to the front body axis 48, the high flexibility zone is reduced.

Preferably, said adjustment means comprise a knob 84 sliding along a lower surface 87 of the functional body 40, connected to the bracket 80 by means of slots 86, 88 obtained through the thickness of the functional body 40.

According to a variant of the invention, the functional body comprises a unitary flexible portion, i.e., consisting of a single piece, made of a deformable material, typically a plastic material, which, by virtue of the elastic deformability of the material, allows the oscillation of the seat and backrest.

According to a further variant of the invention, the differentiated-flexibility zones have a different rigidity as they are made of different materials, having different elastic features.

Innovatively, the oscillation mechanism according to the present invention meets the needs of the field, since it allows the seat and backrest of a chair or armchair to be inclined, while overcoming some of the aforementioned drawbacks, since it is particularly simplified structurally.

In fact, the deformable functional body integrates in a single piece, which is easily achievable by molding plastic materials, the typical functions of the steel or aluminum box and the steel springs of the prior art solutions.

Moreover, advantageously, the user may easily adjust the rigidity of the oscillation mechanism, according to his/her own comfort needs.

It is apparent that, in order to meet contingent needs, those skilled in the art may make changes to the oscillation mechanism described above, all contained within the scope of protection as defined by the following claims.

The invention claimed is:

1. An oscillation mechanism for a seat or a backrest of a chair or of an armchair, comprising a seat coupling, a backrest coupling, and a functional body, wherein the seat coupling and the backrest coupling are hinged to each other in a rear hinge axis, the backrest coupling and the functional body are hinged to each other in a lower hinge axis, and the functional body and the seat coupling are hinged to each other in a front hinge axis, wherein the functional body is made in a single piece of plastic material, wherein at least a portion of the functional body is flexible, the functional body being configured to be elastically deformable by bending between the front hinge axis and the lower hinge axis, for oscillation of the seat and of the backrest, wherein the functional body extends from a rear portion, where the functional body has a rear body axis, to a front portion, where the functional body has a front body axis, wherein the seat coupling extends between a rear portion, where the seat coupling has a rear seat coupling axis, and a front portion, where the seat coupling has a front seat coupling axis, wherein the backrest coupling is L-shaped and comprises a rear coupling portion for connection to the backrest, and a front connection portion having an upper backrest coupling axis and a lower backrest coupling axis, wherein the seat coupling is hinged to the backrest coupling by engaging the rear seat coupling axis with the upper backrest coupling axis by a first pin that forms the rear hinge axis, wherein the functional body is hinged to the backrest coupling by engaging the lower backrest coupling axis with the rear body axis by a second pin that forms the lower hinge axis, and wherein the functional body is hinged to the seat coupling by engaging the front body axis with the front seat coupling axis by a third pin that forms the front hinge axis.

2. The oscillation mechanism of claim 1, wherein the functional body comprises, between the lower hinge axis and the front hinge axis, differentiated-flexibility zones configured to have different rigidity.

3. The oscillation mechanism of claim 2, wherein the functional body comprises a low flexibility zone proximal to the lower hinge axis, and a high flexibility zone proximal to the front hinge axis.

4. The oscillation mechanism of claim 3, wherein said low flexibility zone comprises at least one rib that accentuates rigidity.

5. The oscillation mechanism of claim 1, wherein:

in an initial or resting configuration, the front hinge axis and the rear hinge axis lie on a first imaginary plane;

in a final configuration, the front hinge axis and the rear hinge axis lie on a second imaginary plane; and the second imaginary plane is inclined with respect to the first imaginary plane by an angle corresponding to a maximum inclination of the seat.

6. The oscillation mechanism of claim 5, wherein mutual distance between the front hinge axis, the rear hinge axis, and the lower hinge axis is configured so that a position taken by the rear hinge axis in the final configuration is placed at a predefined height above the first imaginary plane.

7. The oscillation mechanism of claim 1, further comprising adjustment means for manually adjusting flexibility of the functional body.

8. The oscillation mechanism of claim 7, wherein the adjustment means comprise a bracket that engages the functional body to stiffen the functional body, the bracket being manually positionable between the front hinge axis and the lower hinge axis.

9. The oscillation mechanism of claim 8, wherein the adjustment means comprise a knob sliding along a lower surface of the functional body and connected to the bracket, the bracket sliding along an upper surface of the functional body.

10. The oscillation mechanism of claim 9, wherein the knob is connected to the bracket by slots formed through a thickness of the functional body.

* * * * *